US005249629A

United States Patent [19]

Jennings

[11] Patent Number: 5,249,629

[45] Date of Patent: Oct. 5, 1993

[54] FULL BORE CASING HANGER RUNNING TOOL

[75] Inventor: Charles E. Jennings, Houston, Tex.

[73] Assignee: ABB Vetco Gray Inc., Houston, Tex.

[21] Appl. No.: 951,595

[22] Filed: Sep. 28, 1992

[51] Int. Cl.[5] ..... E21B 33/00

[52] U.S. Cl. ..... 166/348

[58] Field of Search ..... 166/344, 348, 382, 387

[56] References Cited

U.S. PATENT DOCUMENTS

| | | | |
|---|---|---|---|
| 3,933,202 | 1/1976 | Ahlstone | 166/182 |
| 4,903,776 | 2/1990 | Nobileau et al. | 166/382 |
| 4,928,769 | 5/1990 | Milberger et al. | 166/382 |
| 4,969,516 | 11/1990 | Henderson et al. | 166/387 X |
| 5,026,097 | 6/1991 | Reimert | 166/348 X |
| 5,044,442 | 9/1991 | Nobileau | 166/348 X |
| 5,148,870 | 9/1992 | Fernandez et al. | 166/348 X |

*Primary Examiner*—Thuy M. Bui
*Attorney, Agent, or Firm*—James E. Bradley

[57] ABSTRACT

A running tool for running casing in a subsea well has a full bore. The running tool is run on casing which will be of the same inner diameter as the diameter of the well casing. The running tool has a body and a movable seal sleeve. The seal sleeve carries a casing hanger seal. After cementing, manipulation of the casing causes the seal sleeve to move downward to a lower position to set the seal.

22 Claims, 6 Drawing Sheets

FULL BORE CASING HANGER RUNNING TOOL

BACKGROUND OF THE INVENTION

1. Field of the invention

This invention relates in general to running tools for running a casing hanger in a subsea well, and in particular to a running tool that is run on casing and has a full bore inner diameter that equals the inner diameters of the running casing and well casing.

2. Description of the Prior Art

In a subsea well, a wellhead housing will be located at the sea floor. As the well is drilled to successive depths, casing will be run and cemented in place. A typical technique for running casing involves securing the casing to a casing hanger, then securing the casing hanger to a running tool. The running tool secures to drill pipe. The operator lowers the string of well casing, casing hanger, and running tool on the drill pipe.

A cement plug will be positioned below the casing hanger and supported by the running tool. Once the casing hanger lands in the wellhead housing, the operator will pump cement down the bore of the drill pipe. The cement passes through the plug and flows down the well casing, then back up the annulus surrounding the casing.

After the desired amount of cement has been pumped into the drill pipe, the operator will pump a ball or dart down the bore of the drill pipe. The ball will contact the plug and push the cement plug down to the bottom of the casing. The cement plug then locates at the upper level of cement, and forces all of the cement out of the well casing and up into the annulus.

The running tool frequently will have a seal sleeve mounted to it which carries a casing hanger seal. After cementing, the operator will actuate the seal sleeve, moving it downward relative to the casing hanger to position the seal between the casing hanger and the wellhead housing bore. In some cases, the running tool will also set the seal to the desired force. A variety of different structures have been known in the prior art to move the seal sleeve down. These structures include hydraulic systems that are actuated by pulling up on the drill pipe or moving the drill pipe downward. The systems also include torque setting by rotation of the drill pipe, or pumping fluid down the drill pipe.

Running tools of this nature work sufficiently well. However, one drawback is that with a very long string, the weight of the string of casing may exceed the strength of the string of drill pipe. Also, the drill pipe has an inner diameter that is much smaller than the inner diameter of the well casing. The cement plug must initially be located below the drill pipe during the running in procedure, which has some disadvantages.

Full bore casing hanger running tools are available for elastomeric casing hanger seals of some types. In the prior art type, the casing hanger seal is initially carried on the exterior of the casing hanger by threads. Flowby slots on the casing hanger allow the bypass of cement returns when cementing. After cementing, the running tool will engage the seal assembly and through rotation will move the seal downward into position. The seal is set by torque. While this works well enough, securing the seal assembly by threads to the casing hanger requires a longer casing hanger than running tools which carry the seal on a seal sleeve mounted to the running tool.

SUMMARY OF THE INVENTION

In this invention, the running tool is of a full bore type, allowing the cement plug to be pumped from the surface. Also, the running tool has a seal sleeve mounted to it that carries the casing hanger seal. After cementing, positioning means incorporated with the running tool will move the seal sleeve from an upper position down to a lower position between the casing hanger and the wellhead housing bore.

In a preferred embodiment, the positioning means comprises a J-pin and J-slot arrangement located between a body of the running tool and the seal sleeve. Rotation of the running casing less than one turn will move the J-pins into an axial portion of the J-slot, allowing the seal sleeve to move downward relative to the body.

A guide means locates in the running tool between the body and the connection means for connecting the running tool seal sleeve to the running casing. This guide means has an inner diameter that is not less than the inner diameter of the running casing and well casing. The guide means will collapse when the seal sleeve moves to the lower position. Preferably, the guide means comprises upper and lower slotted cylinders which define alternating intermeshing fingers.

A seal connection means connects the seal sleeve to the casing hanger seal. The seal connection means will automatically release the seal sleeve from the casing hanger seal when the seal sleeve is in the lower position. The seal connection means comprises a resilient split ring that moves between an inner and outer position. A release member mounts to the split ring and engages the exterior of the body. The body has a recess located in its lower portion. When the release member reaches the recess, it moves inward due to the inward bias of the split ring. This retracts the split ring and frees the engagement with the casing hanger seal.

DETAILED DESCRIPTION OF THE INVENTION

Figure 1A:
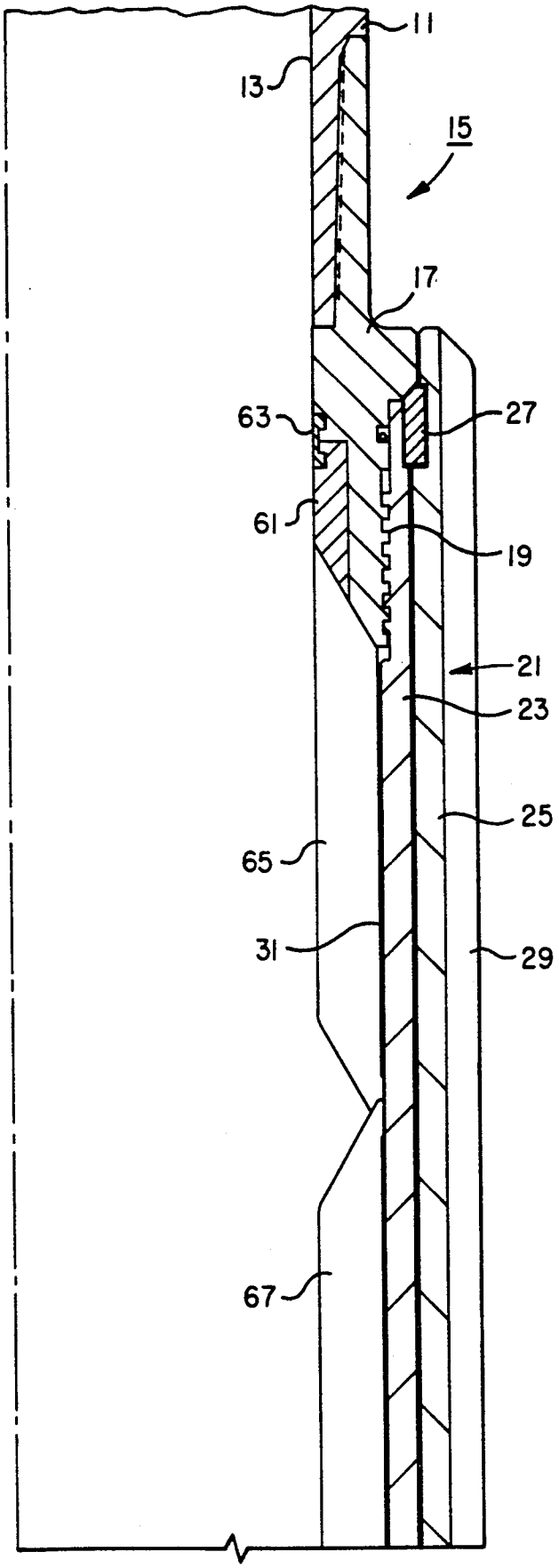
FIGS. 1*a*, 1*b* and 1*c* make up a quarter sectional view of a running tool constructed in accordance with this invention, and shown in the running in position.

Referring to FIG. 1*a*, the lower end of a string of running casing is shown. Running casing is a string of pipe that will extend to a drilling vessel at the surface of the water. Running casing 11 has a bore 13 and external threads for securing to a running tool 15. Running casing 15 is of a type that could be installed in a well, but in this instance, it is used to lower running tool 15 and is not installed in a well.

Running tool 15 includes a casing adapter 17 which serves as connection means for connecting running tool 15 to running casing 11. Casing adapter 17 is a threaded member that engages running casing 11. Casing adapter 17 has external threads 19 on its lower end. A seal sleeve 21 secures to casing adapter 17.

Seal sleeve 21 Comprises two sleeves, inner sleeve 23 and outer sleeve 25. Inner sleeve 23 has internal threads that secure to the external threads 19, thus will move in unison both rotationally and axially with running casing 11. Outer sleeve 25 secures to inner sleeve 23 by a retainer ring 27. Inner sleeve 23 and outer sleeve 25 are axially immovable relative to each other, but inner sleeve 23 can rotate relative to outer sleeve 25 because of retainer ring 27. A plurality of flow slots 29 extend along the exterior of outer sleeve 25 for the passage of cement returns. Inner sleeve 23 has a bore 31 with an inner diameter that is greater than the inner diameter of bore 13 of running casing 11.

Figure 1B:
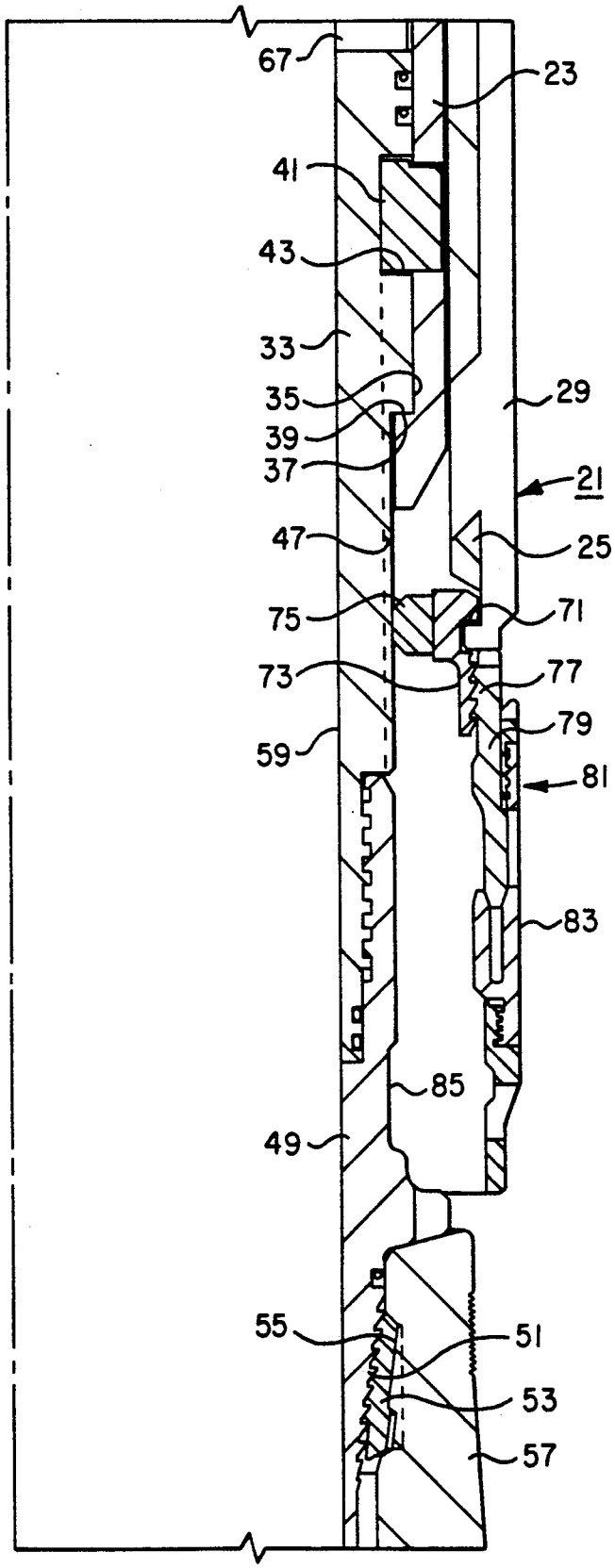

Referring to FIG. 1*b*, inner sleeve 23 slidingly engages a body 33. Body 33 is a tubular member having an exterior surface 35 that is in sliding engagement with bore 31 of inner sleeve 23. Body 33 has a downward facing shoulder 37. A load shoulder 39, which faces upward, is formed on the lower end of inner sleeve 23 for engaging body shoulder 37.

Figure 2A:
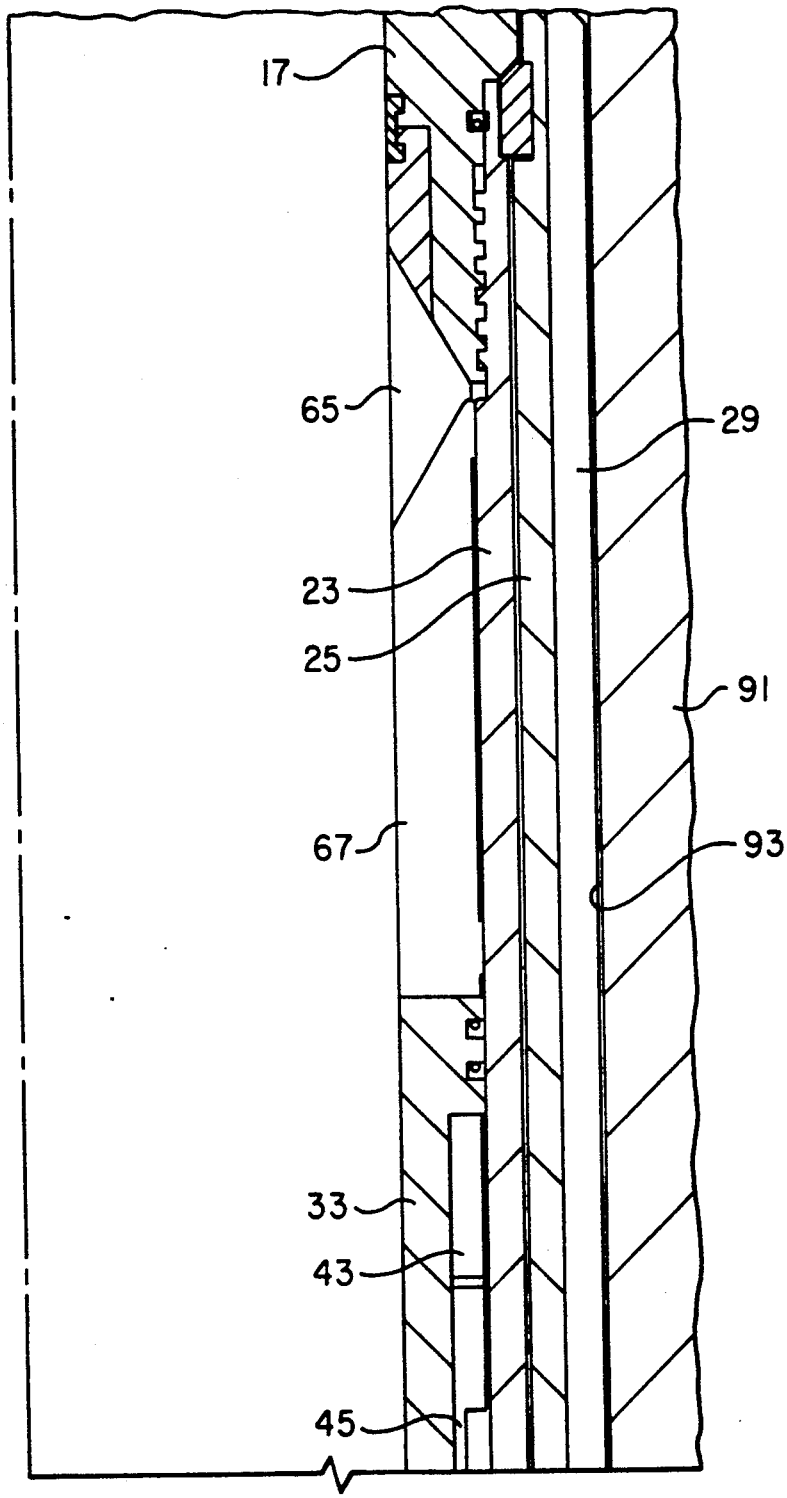
FIGS. 2*a* and 2*b* comprise a quarter sectional view of portions of the running tool of FIG. 1, showing the seal sleeve of the running tool in a lower position.
Figure 2B:
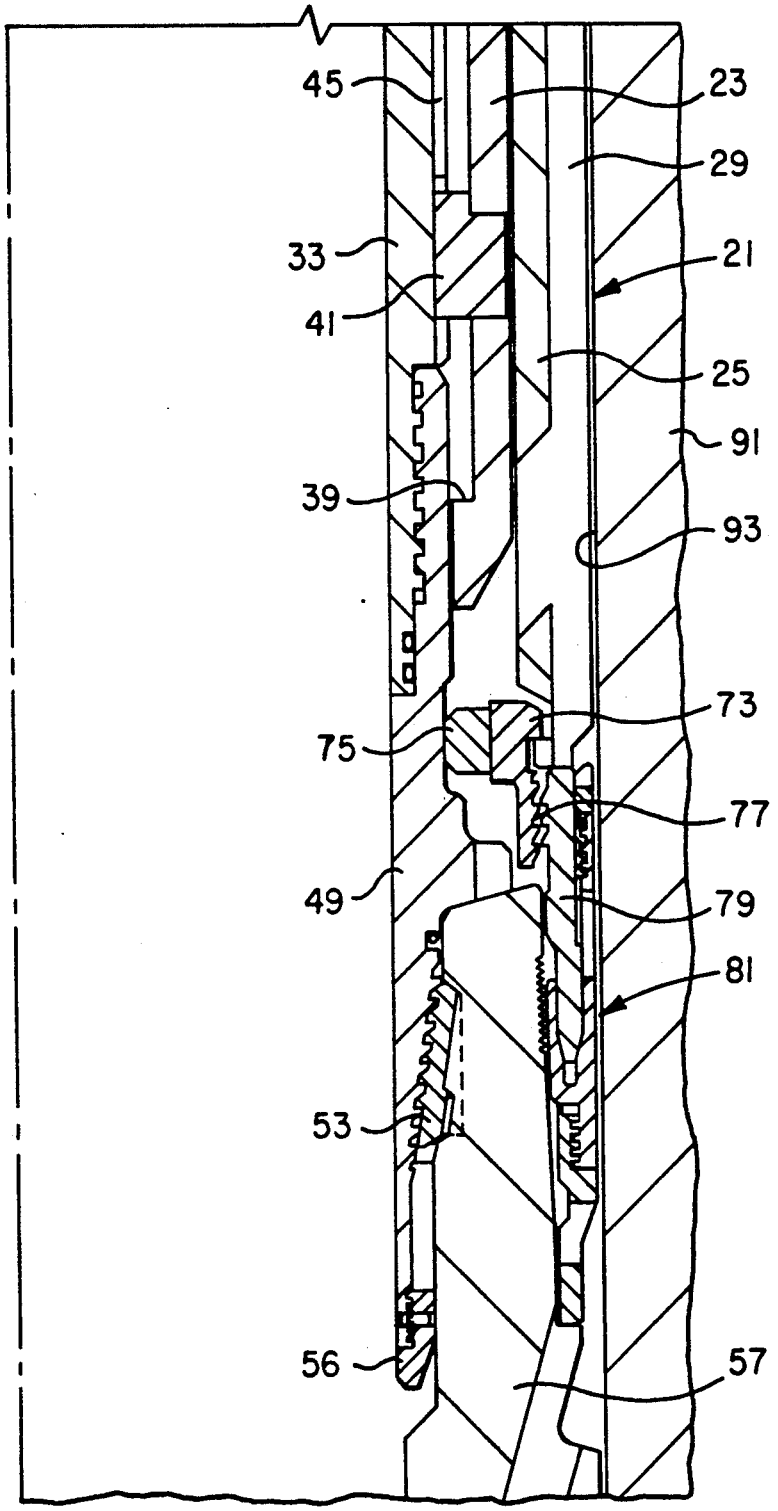

As can be seen by comparing FIGS. 1*a* and 1*b* with FIGS. 2*a* and 2*b*, inner sleeve 23 will move downward from an upper position shown in FIGS. 1*a* and 1*b* to a lower position shown in FIGS. 2*a* and 2*b*. A positioning means accomplishes the movement between the two positions by rotation of running casing 11 (FIG. 1*a*) less than one turn, then allowing the weight of the running casing 11 to move the seal sleeve 21 downward. The positioning means includes two J-pins 41 (only one shown), each spaced 180 degrees apart from each other. Each J-pin 41 is stationarily mounted to inner sleeve 23, extends through the wall of inner sleeve 23, and protrudes into bore 31. As shown by the dotted line in FIG. 3, J-pin 41 is generally rectangular in configuration.

Figure 3:
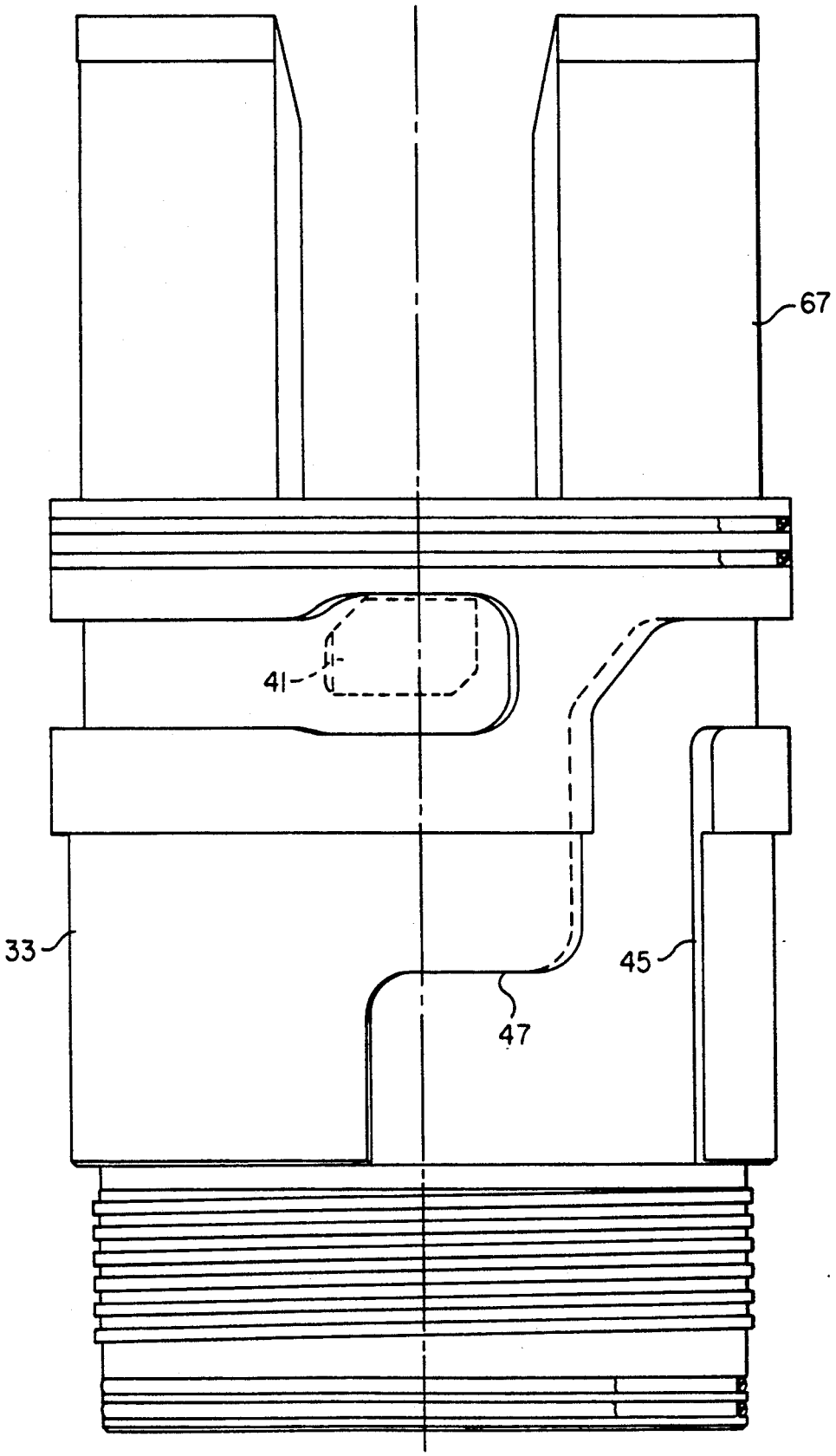
FIG. 3 is an isometric view of the body of the running tool of FIG. 1.

Referring still to FIG. 3, body 33 has for each J-pin 41 an upper circumferential J-slot 43. An axial J-slot 45 for each J-pin 41 extends axially downward, parallel to the longitudinal axis of running tool 15. Each axial J-slot 45 intersects upper circumferential J-slot 43. A lower circumferential J-slot 47 intersects each axial J-slot 45 and extends a short circumferential distance. The lower circumferential J-slots 47 are located below upper circumferential J-slot 43 and at the lower end of axial J-slot 45.

In the upper position shown in FIG. 1*b*, each J-pin 41 is located in the upper circumferential J-slot 43. Rotating running casing 11 (FIG. 1*a*) about one-half turn will align J-pins 41 with axial J-slots 45. The weight of running casing 11 will then cause the J-pin 41 and seal sleeve 21 to move downward relative to body 33 to the lower position shown in FIG. 2*b*.

Referring again to FIG. 1*b*, body 33 has a lower portion which comprises an adapter 49. Adapter 49 is a tubular member having external threads 51 formed on a conical portion of its lower end. Threads 51 carry a split latch ring 53, which engages a groove 55 formed in a conventional casing hanger 57. Latch ring 53 will releasably secure the running tool 15 to casing hanger 57. During the releasing procedure, adapter 49 will unscrew from latch ring 53. Latch ring 53 is resilient and is biased radially inward. A retainer ring 56 (FIG. 1*c*) secured to adapter 49 below threads 51 will catch latch ring 53 and retrieve it to the surface along with adapter 49. U.S. Pat. No. 4,903,992, issued Feb. 27, 1990, Charles E. Jennings, describes more details of latch ring 53.

Referring still to FIG. 1*b*, body 33 and adapter 49 have a bore 59. Bore 59 has the same inner diameter as bore 13 of running casing 11. Bore 59 is smooth and unobstructed so as to allow the passage of a cement plug (not shown).

Referring to FIG. 1*a*, guide means locates in the annular clearance surrounding bore 31 of seal sleeve 21. Bore 31 is of a larger diameter than bore 13 and bore 59, thus in some cases for short cement plugs, could possibly cause the cement plug to catch on the upper end of body 33. If the cement plug had an axial length greater than the distance from the lower end of casing adapter 17 to the upper end of body 33 when the seal sleeve 21 is in the upper position, then there would be little likelihood of the cement plug becoming cocked and catching on the upper end of body 33. In the case of shorter cement plugs, however such might occur. The guide means will prevent this occurrence.

In the preferred embodiment, the guide means comprises upper finger ring 61, which secures by a retainer ring 63 to adapter 17. Upper finger ring 61 has a plurality of upper fingers 65 that depend downward. Upper fingers 65 are formed by milling slots in the upper finger ring 61. Similarly, lower fingers 67 formed by milled slots extend upward from the upper end of body 33. Lower fingers 69 intermesh and alternate with upper fingers 65. The inner diameter of the upper and lower fingers 65, 67 is the same as the inner diameter of bore 13 and bore 59 (FIG. 1*b*). When seal sleeve 21 is moving to the lower position, upper fingers 65 will move downward, sliding against lower fingers 67 as can be seen by comparing FIG. 1*a* with FIG. 2*a*.

Referring again to FIG. 1*b*, outer sleeve 25 has an inward protruding retaining shoulder 71 that faces upward. An inward biased split ring 73 has an annular recess formed around it for engaging retaining shoulder 71. Split ring 73 has a plurality of pins or release members 75 (only one shown) spaced circumferentially around its inner diameter. Release members 75 engage the exterior of body 33, but will not enter the J-slots 43, 45, 47. The length of release member 75 is selected so as to push split ring 73 outward to keep it in an outer position shown in FIG. 1*b*.

Split ring 73 has a set of threads 77 on its exterior. A solid energizing ring 79 has mating interior threads that screw onto threads 77. Energizing ring 79 is part of a conventional casing hanger seal assembly 81. In the preferred embodiment, seal assembly 81 is of a metal type, having a U-shaped metal seal that is pushed apart into sealing engagement by means of energizing ring 79. U.S. Pat. No. 4,932,472, issued Jun. 12, 1990, Carl F. Boehm, Jr., describes more details of the seal assembly 81 shown. Split ring 73, retaining shoulder 71, and release members 75 serve as a seal connection means for connecting the seal assembly 81 to the outer sleeve 25 of seal sleeve 21.

As seal sleeve 21 moves downward, release members 75 will slide on the exterior of body 33 and adapter 49. A recess 85 on the exterior of body adapter 49 will eventually be engaged by the release members 75 when seal sleeve 21 reaches its lower position. When this occurs, release members 75 are pushed inward by the inward bias of split ring 73 into recess 85. This movement releases the threads 77 from the seal assembly 81. This position is shown in FIG. 2*b*.

Figure 1C:
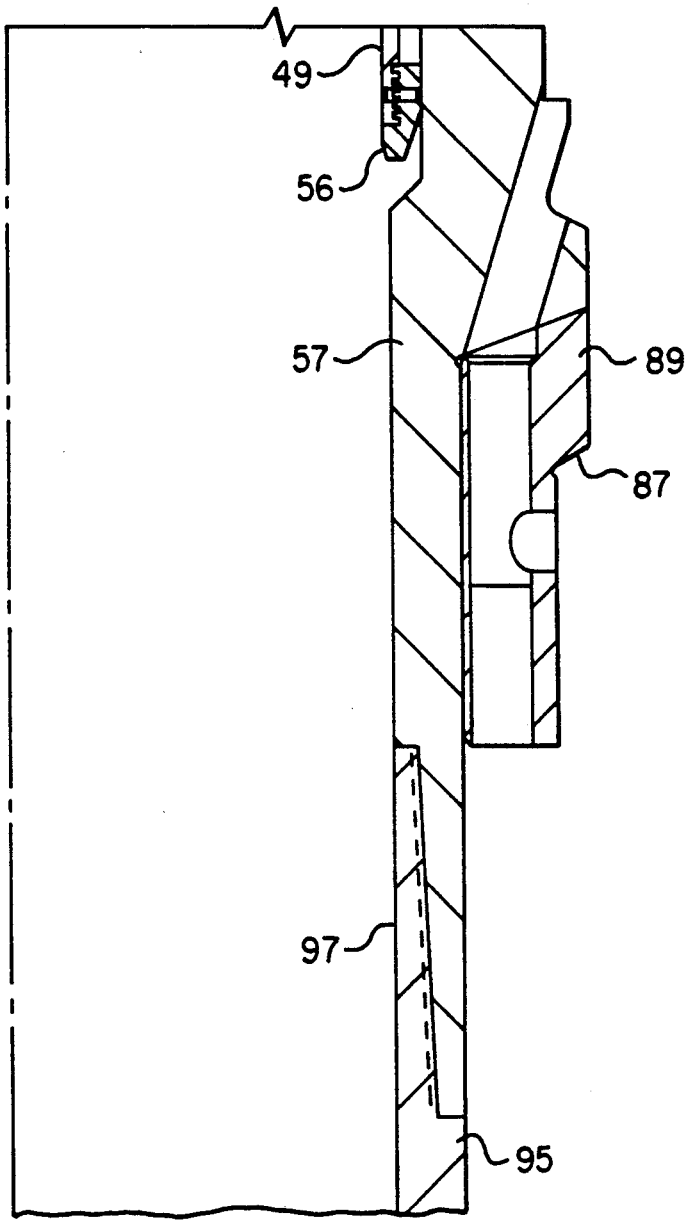

Referring to FIG. 1*c*, casing hanger 57 has a downward facing conical load shoulder 87. In the embodiment shown, load shoulder 87 is part of a load ring 89 which secures to and forms a part of casing hanger 57. Load shoulder 87 will land on an upward facing load shoulder (not shown) located in wellhead housing 91 (FIG. 2*b*). The load shoulder will be formed in bore 93 of wellhead housing 91.

Referring again to FIG. 1*c*, a string of well casing 95 secures to the lower end of casing hanger 57. Well casing 95 has a bore 97 that is the same as the bore 13 of running casing 11 (FIG. 1*a*) as well as the bore 59 of running tool body 33.

In operation, the operator will assemble a string of well casing 95, lowering it section by section from the drilling vessel. Casing hanger 57 will be secured to the upper end of the well casing 95. Running tool 15 will be secured to the casing hanger 57 by latch ring 53. Seal assembly 81 Will be assembled on the seal sleeve 21, which will be in the upper position shown in FIGS. 1*a* and *b*.

The operator secures a string of running casing 11 to the running tool 15 and lowers the running tool 15, casing hanger 57 and well casing 95, section by section as the running casing 11 is made up. When the casing hanger load shoulder 87 lands in wellhead housing 91, the operator will begin cementing. The operator pumps cement down the running casing 11, through the body bore 59 (FIG. 1*b*) and down through the well casing bore 97. The cement will flow down well casing 95 and begin returning back up the annulus surrounding well casing 95.

When the operator has pumped the selected amount of cement, he will place a conventional cement plug (not shown) into the upper end of running casing 11 at the drilling vessel. The operator pumps the cement plug down with a fluid such as water. The cement plug, which would be located at the upper level of the cement, pushes the cement downward and back up the annulus surrounding well casing 95. The cement plug will pass through the running tool 15 and proceed to the bottom of well casing 95 where it engages a conventional cement shoe (not shown).

The operator then will rotate the running casing 11 about one-half turn, causing inner sleeve 23 to rotate relative to body 33. J-pins 41 will move into the axial J-slots 45. The weight of running casing 11 will cause the seal sleeve 21 to move downward. Seal assembly 81 will locate in an annular space between the casing hanger 57 and bore 93 of wellhead housing 91, as shown in FIG. 2*b*. Energizing ring 79 will move downward relative to seal 83 to partially set seal 83. At the same time, release member 75 will engage recess 85, causing split ring 73 to retract from engagement with energizing ring 79. This releases seal sleeve 21 from seal assembly 81.

The operator will then pull upward about 5,000 pounds above the weight of running casing 11 and rotate two and one-half turns to the right. This causes the adapter 49 to unscrew from latch ring 53. This releases the running tool 15 from casing hanger 57. The operator then continues pulling upward. The retainer 56 (FIG. 1*c*) will catch the released latch ring 53 to retrieve it along with running tool 15. The rotation while pulling upward will cause the J-pins 41 to enter the lower circumferential J-slots 43 during retrieval.

The operator will then complete the setting of seal assembly 81. This may be done in a number of manners. A test tool may be employed to utilize pressure caused by fluid being pumped from the surface to perform the final setting. A setting tool could be lowered from the vessel to set the seal assembly 81.

This invention has significant advantages. The running tool is full bore. This allows the running casing to have the same diameter as the well casing. This enables the operator to pump the cement plug from the drilling vessel, rather than suspending it from the running tool during the running procedure. The running casing, being of the same type as the well casing, Will have sufficient strength to support the weight of the well casing. Carrying the casing hanger seal initially on the running tool, rather than on the casing hanger, allows a shorter length of casing hanger to be employed.

While the invention has been shown in only one of its forms, it should be apparent to those skilled in the art that it is not so limited, but is susceptible to various changes without departing from the scope of the invention.

I claim:

1. In a subsea well having a wellhead housing located at a sea floor, a running tool for running and landing in the wellhead housing on a string of running casing a casing hanger secured to a string of well casing, and for positioning a casing hanger seal between the casing hanger and wellhead housing, the running casing and well casing being of the same inner diameter, the running tool comprising in combination:

running tool connection means for connecting the running tool to the running casing;

a tubular body having an exterior and a lower end, the body having an unobstructed bore therethrough that has an inner diameter at least equal to the inner diameter of the running casing and well casing so as to allow a cement plug to be pumped downward through the running casing, body and well casing during cementing of the well casing;

casing hanger connection means on the lower end of the body for connecting the body to the casing hanger during running in and for releasing the body from the casing hanger after the well casing has been cemented;

a seal sleeve carried by the body on the exterior of the body;

seal connection means on the seal sleeve for releasably connecting the casing hanger seal to the seal sleeve; and positioning means for carrying the seal sleeve and casing hanger seal in an upper position relative to the body during running in and cementing, and for moving the seal sleeve and casing hanger seal downward to a lower position after cementing, positioning the casing hanger seal between the casing hanger and wellhead housing, the seal connection means releasing the casing hanger seal from the seal sleeve after the seal sleeve is in the lower position.

2. The running tool according to claim 1 wherein the positioning means moves the seal sleeve and casing hanger seal to the lower position in response to axial movement of the running casing after the casing hanger has landed in the wellhead housing.

3. The running tool according to claim 1 wherein the positioning means moves the seal sleeve and casing hanger seal to the lower position in response to axial movement of the running casing after the casing hanger has landed in the wellhead housing, the axial movement requiring no more than one rotation of the running casing.

4. The running tool according to claim 1 wherein the positioning means moves the seal sleeve and casing hanger seal to the lower position after the casing hanger has landed in the wellhead housing in response to rotation of the running casing of less than one turn, then axial movement of the running casing.

5. The running tool according to claim 1 wherein the positioning means moves the seal sleeve and casing hanger seal to the lower position after the casing hanger has landed in the wellhead housing in response to rotation of the running casing of less than one turn, then straight downward movement of the running casing.

6. The running tool according to claim 1 wherein the running tool connection means connects the seal sleeve to the running casing for movement therewith.

7. The running tool according to claim 1 wherein the casing hanger connection means immovably connects the body to the casing hanger until after the positioning means has moved the seal sleeve to the lower position.

8. In a subsea well having a Wellhead housing located at a sea floor, a running tool for running and landing in the wellhead housing on a string of running casing a casing hanger secured to a string of well casing, and for positioning a casing hanger seal between the Casing hanger and wellhead housing, the running casing and well casing being of the same inner diameter, the running tool having a longitudinal axis and comprising in combination:

a tubular body having an exterior and a lower end, the body having an unobstructed bore therethrough that has an inner diameter at least equal to the inner diameter of the running casing and well casing so as to allow a cement plug to be pumped downward through the running casing body and well casing during cementing of the well casing;

casing hanger connection means on the lower end of the body for connecting the body to the casing hanger during running in and for releasing the body from the casing hanger after the well casing has been cemented;

a seal sleeve carried by the body on the exterior of the body;

running tool connection means for connecting the seal sleeve to the running casing;

seal connection means on the seal sleeve for releasably connecting the casing hanger seal to the seal sleeve;

positioning means engaging the seal sleeve and the body for carrying the seal sleeve and casing hanger seal in an upper position relative to the body during running in and cementing, and for moving the seal sleeve and casing hanger seal downward to a lower position in response to downward movement of the running casing, positioning the casing hanger seal between the casing hanger and wellhead housing after cementing; and wherein the casing hanger connection means immovably connects the body to the casing hanger until after the positioning means has moved to the lower position, then releases the running tool from the casing hanger in response to upward movement of the running casing, and wherein the seal connection means releases the casing hanger seal from the seal sleeve after the seal sleeve is in the lower position.

9. The running tool according to claim 8 wherein the positioning means moves the seal sleeve and casing hanger seal to the lower position after the casing hanger has landed in the wellhead housing in response to rotation of the running casing of less than one turn, then straight downward movement of the running casing.

10. The running tool according to claim 8 wherein the running tool connection means connects the seal sleeve to running casing for movement therewith.

11. The running tool according to claim 8 wherein the body has a cylindrical surface on the exterior of the body that is slidingly received within an interior cylindrical surface in the seal sleeve, and wherein the positioning means comprises:

a J-slot formed in one of the cylindrical surfaces, having a circumferential portion and an axial portion perpendicular to the circumferential portion; and a J-pin secured to the other of the cylindrical surfaces in engagement with the J-slot, the J-pin being located in the circumferential portion during the running in of the casing hanger and being movable to the axial portion by rotation of the running casing relative to the casing hanger and body to cause the seal sleeve to move axially downward to the lower position.

12. The running tool according to claim 8 wherein the seal connection means comprises:

a resilient inwardly biased split ring movable radially between an outer position and an inner position, the split ring having a grooved exterior for engaging an interior surface of the casing hanger seal when in the outer position; and casing hanger seal release means for causing the split ring to move to the inner position when the positioning means moves the seal sleeve to the lower position.

13. The running tool according to claim 8 wherein the casing hanger connection means comprises:

a set of external threads at the lower end of the body;

a set of internal threads in an interior portion of the casing hanger which are engaged by the external threads, requiring rotation of the body and the running casing to release from the casing hanger; and wherein the seal connection means releases the seal sleeve from the casing hanger seal prior to rotation of the body.

14. The running tool according to claim 8 wherein: the running tool connection means Comprises an adapter sleeve secured to an upper end of the seal sleeve, the adapter sleeve having a lower end and having an inner diameter substantially equal to the inner diameter of the bore of the body;

the body has an upper end spaced below the lower end of the adapter sleeve;

the seal sleeve has an inner diameter between the upper end of the body and the lower end of the adapter sleeve that is greater than the inner diameters of the bore of the body and the inner diameter of the adapter sleeve, defining an annular clearance which reduces in axial length when the seal sleeve moves to the lower position; and wherein the running tool further comprises:

guide means located in the annular clearance for providing an inner diameter substantially equal to the inner diameters of the adapter sleeve and bore of the body to facilitate passage of the plug through the running tool.

15. The running tool according to claim 8 wherein:

the running tool connection means comprises an adapter sleeve secured to an upper end of the seal sleeve, the adapter sleeve having a lower end and having an inner diameter substantially equal to the inner diameter of the bore of the body;

the body has an upper end spaced below the lower end of the adapter sleeve;

the seal sleeve has an inner diameter between the upper end of the body and the lower end of the adapter sleeve that is greater than the inner diameters of the bore of the body and the bore of the adapter sleeve, defining an annular clearance which reduces in axial length when the seal sleeve moves to the lower position; and wherein the running tool further comprises:

a plurality of upper fingers circumferentially spaced apart from each other, and secured to and extending downward from the adapter sleeve; and a plurality of lower fingers circumferentially spaced apart from each other, located between and alternating with the upper fingers, the lower fingers being at the upper end of the body, the upper and lower fingers having inner diameters substantially equal to the inner diameters of the adapter sleeve and bore of the body to facilitate passage of the plug through the running tool.

16. In a subsea well having a wellhead housing located at a sea floor, a running tool for running and landing in the wellhead housing on a string of running casing a casing hanger secured to a string of well casing, and for positioning a casing hanger seal between the casing hanger and wellhead housing, the running tool having a longitudinal axis and comprising in combination:

a tubular body having an exterior cylindrical surface and a lower end;

casing hanger connection means on the lower end of the body for connecting the body to the casing hanger during running in and for releasing the body from the casing hanger after the well casing has been cemented;

a seal sleeve carried by the body on the exterior, the seal sleeve having an interior cylindrical surface in sliding engagement with the exterior cylindrical surface of the body;

running tool connection means for connecting the seal sleeve to the running casing;

seal connection means on the seal sleeve for releasably connecting the casing hanger seal to the seal sleeve;

a J-slot formed in one of the cylindrical surfaces, having a circumferential portion and an axial portion perpendicular to the circumferential portion;

a J-pin secured to the other of the cylindrical surfaces in engagement with the J-slot, the J-pin being located in the circumferential portion during the running in of the casing hanger, positioning the casing hanger seal in an upper position relative to the body, and being movable to the axial portion by rotation of the running casing and seal sleeve relative to the casing hanger and body to cause the seal sleeve to move axially downward to position the casing hanger seal in a lower position between the casing hanger and wellhead housing after cementing; and wherein the casing hanger connection means immovably connects the body to the casing hanger until after the casing hanger seal has moved to the lower position, then releases the running tool from the casing hanger in response to upward movement of the running casing, and wherein the seal connection means releases the casing hanger seal from the seal sleeve after the casing hanger seal is in the lower position.

17. The running tool according to claim 16 wherein the seal connection means comprises:

a resilient split ring movable radially between an outer position and an inner position, the split ring having a grooved exterior for engaging an interior surface of the casing hanger seal when in the outer position; and casing hanger seal release means for causing the split ring to move to the inner position when the positioning means moves the seal sleeve to the lower position.

18. The running tool according to claim 16 wherein the casing hanger connection means comprises:

a set of external threads at the lower end of the body;

a set of internal threads in an interior portion of the casing hanger which are engaged by the external threads, requiring rotation of the body and the running casing to release from the casing hanger; and wherein the seal connection means releases the seal sleeve from the seal prior to rotation of the body.

19. The running tool according to claim 16 wherein:

the running tool connection means comprises an adapter sleeve secured to an upper end of the seal sleeve, the adapter sleeve having a bore and a lower end;

the body has a bore and an upper end spaced below the lower end of the adapter sleeve;

the seal sleeve has an inner diameter between the upper end of the body and the lower end of the adapter sleeve that is greater than inner diameters of the bore is of the body and the bore of the adapter sleeve, defining an annular clearance which reduces in axial length when the seal sleeve moves to the lower position; and wherein the running too) further comprises:

guide means located in the annular clearance for providing an inner diameter substantially equal to the inner diameters of the adapter sleeve and bore of the body to facilitate passage of a plug through the running tool.

20. The running tool according to claim 16 wherein:

the running tool connection means comprises an adapter sleeve secured to an upper end of the seal sleeve, the adapter sleeve having a lower end and having a bore with an inner diameter;

the body has an upper end spaced below the lower end of the adapter sleeve and a bore with an inner diameter substantially equal to the inner diameter of the bore of the adapter sleeve;

the seal sleeve has an inner diameter between the upper end of the body and the lower end of the adapter sleeve that is greater than the inner diameters of the bore of the body and the bore of the adapter sleeve, defining an annular clearance which reduces in axial length when the seal sleeve moves to the lower position; and wherein the running tool further comprises:

a plurality of upper fingers circumferentially spaced apart from each other, and secured to and extending downward from the adapter sleeve; and a plurality of lower fingers circumferentially spaced apart from each other, located between and alternating with the upper fingers, the lower fingers being located in the clearance at the upper end of the body, the upper and lower fingers having inner diameters substantially equal to the inner diameters of the bore of the adapter sleeve and bore of the body to facilitate passage of a plug through the running tool.

21. The running tool according to claim 16 wherein the seal connection means comprises:

an inwardly biased resilient split ring movable radially between an outer position and an inner position, the split ring having a grooved exterior for engaging an interior surface of the casing hanger seal when in the outer position;

a release member protruding radially inward split ring into sliding engagement with the body to maintain the split ring in the outer position while the seal sleeve is above the lower position; and a recess formed on the body for receiving the release member when the seal sleeve reaches the lower position, allowing the split ring to retract to the inner position to disengage from the casing hanger seal.

22. A method of installing casing in a subsea wellhead housing, comprising:

connecting a casing hanger to an upper end of a string of well casing;

providing a casing hanger running tool with a bore therethrough which has a body with an inner diameter at least equal to an inner diameter of the well casing, and which has a seal sleeve that is movable relative to the body between upper and lower positions;

connecting a casing hanger seal to the seal sleeve and positioning the seal sleeve in the upper position; then connecting the running tool to the casing hanger and to a string of running casing which has an inner diameter equal to the inner diameter of the well casing; then lowering the well casing into the well and landing the casing hanger in the wellhead; then pumping cement down the running casing, through the running tool, down the well casing, and back up an annulus surrounding the well casing; then moving the seal sleeve to the lower position, locating the casing hanger seal between the casing hanger and the wellhead housing; then releasing the seal sleeve from the casing hanger seal and releasing the running tool from the casing hanger, and retrieving the running tool with the running casing.

* * * * *

UNITED STATES PATENT AND TRADEMARK OFFICE

CERTIFICATE OF CORRECTION

PATENT NO. : 5,249,629

DATED : 10/5/93

INVENTOR(S) : Charles E. Jennings

It is certified that error appears in the above-identified patent and that said Letters Patent is hereby corrected as shown below:

On the title page, item [75] Inventor:
The inventor should include also--Lawrence A. Eckert and Herman O. Henderson, Jr., both of Houston, Texas--;

At column 2, line 66, "Comprises" should be--comprises--;

At column 5, line 11, "Will" should be--will--;

At column 6, line 3, "Will" should be--will--;

At column 7, line 14, "Wellhead" should be--wellhead--;

At column 7, line 18, "Casing" should be--casing--;

At column 8, line 41, "Comprises" should be--comprises--;

At column 11, line 10, after "inward"--from the--should be inserted.

Signed and Sealed this

Fifth Day of April, 1994

Bruce Lehman

*Attest:*

BRUCE LEHMAN

*Attesting Officer*

*Commissioner of Patents and Trademarks*